US011236556B2

(12) United States Patent
Gullaksen et al.

(10) Patent No.: US 11,236,556 B2
(45) Date of Patent: Feb. 1, 2022

(54) VERTICAL PIPE HANDLING

(71) Applicant: Cameron International Corporation, Houston, TX (US)

(72) Inventors: Rolf Gullaksen, Richmond, TX (US); Erling Tambs, Kristiansand (NO)

(73) Assignee: Schlumberger Technology Corporaiton, Sugar Land, TX (US)

( * ) Notice: Subject to any disclaimer, the term of this patent is extended or adjusted under 35 U.S.C. 154(b) by 256 days.

(21) Appl. No.: 16/168,756

(22) Filed: Oct. 23, 2018

(65) Prior Publication Data

US 2019/0119995 A1 Apr. 25, 2019

Related U.S. Application Data

(60) Provisional application No. 62/576,792, filed on Oct. 25, 2017.

(51) Int. Cl.

| | |
|---|---|
| ***E21B 19/15*** | (2006.01) |
| ***E21B 19/14*** | (2006.01) |
| *E21B 17/00* | (2006.01) |

(52) U.S. Cl.

CPC ..... *E21B 19/155* (2013.01); *E21B 19/14* (2013.01); *E21B 19/143* (2013.01); *E21B 17/00* (2013.01)

(58) Field of Classification Search

CPC ..... E21B 19/14; E21B 19/20; E21B 19/155; E21B 19/143; E21B 17/00; B65G 1/0442; F16L 1/207; A47B 81/007

See application file for complete search history.

(56) References Cited

U.S. PATENT DOCUMENTS

| | | | | | |
|---|---|---|---|---|---|
| 2,619,234 | A * | 11/1952 | Stone | E21B 19/14 | 211/70.4 |
| 2,773,605 | A * | 12/1956 | De Jarnett | E21B 19/14 | 414/22.71 |
| 3,630,392 | A * | 12/1971 | Cintract | B65G 1/0442 | 414/746.8 |
| 3,799,364 | A * | 3/1974 | Kelly | E21B 19/14 | 414/22.71 |
| 4,042,123 | A * | 8/1977 | Sheldon | E21B 19/20 | 414/22.71 |
| 4,621,974 | A * | 11/1986 | Krueger | E21B 19/20 | 211/70.4 |
| 5,724,785 | A * | 3/1998 | Malanowski | B65B 21/24 | 198/728 |
| 6,976,540 | B2 * | 12/2005 | Berry | E21B 19/00 | 166/380 |
| 7,083,007 | B2 * | 8/2006 | Herst | E21B 19/14 | 175/52 |
| 7,699,122 | B2 * | 4/2010 | Eriksen | E21B 19/14 | 175/52 |

(Continued)

FOREIGN PATENT DOCUMENTS

| | | | | |
|---|---|---|---|---|
| WO | WO-2016075478 A1 * | 5/2016 | ..... | E21B 19/14 |

*Primary Examiner* — Gregory W Adams
(74) *Attorney, Agent, or Firm* — Kelly McKinney

(57) ABSTRACT

A vertical pipe handling system comprising a bellyboard with at least one automated guide for leading tubulars between the fingers of the bellyboard. A method to move a tubular on or above a rig floor comprising automatically moving the tubular with a racking system comprising a bellyboard with at least one automated guide for leading tubulars between the fingers of the bellyboard.

20 Claims, 13 Drawing Sheets

(56) References Cited

U.S. PATENT DOCUMENTS

| | | | | |
|---|---|---|---|---|
| 7,712,599 | B1 * | 5/2010 | Landrum | B65G 47/2445 198/411 |
| 8,678,177 | B2 * | 3/2014 | Henderson | B65G 19/00 198/699.1 |
| 8,961,093 | B2 * | 2/2015 | Springett | E21B 19/20 211/70.4 |
| 9,206,656 | B2 * | 12/2015 | Roodenburg | A47F 7/0028 |
| 10,246,952 | B2 * | 4/2019 | Trydal | E21B 19/14 |

* cited by examiner

VERTICAL PIPE HANDLING

REFERENCE TO RELATED APPLICATION

This application claims the benefit of and incorporates by reference U.S. Provisional Patent Application Ser. No. 62/576,792 filed on Oct. 25, 2017.

TECHNICAL FIELD

This present disclosure relates to pipe handling equipment used on various drilling rigs, like jackup rigs, semisubmersible rigs, drill ships, or land rigs, and, in particular, to equipment used to perform vertical drilling tubular handling operations on the drill floor.

BACKGROUND

This section is intended to introduce the reader to various aspects of art that may be related to various aspects of the present disclosure, which are described or claimed below. This discussion is believed to be helpful in providing the reader with background information to facilitate a better understanding of the various aspects of the present disclosure. Accordingly, it should be understood that these statements are to be read in this light, and not as admissions of prior art.

Drilling tubulars include drill pipe, tubing, and casing ("tubulars"), which are assembled by threading one section of tubular to the next. Management of tubulars on the drill floor is conducted by various vertical pipe handling components and features that retrieve tubular, position the tubular into the mousehole, and tighten one tubular to the next.

One of these handling components is the fingerboard, which is part of a racking system. Known racking systems include bridge rackers. These systems rely on components on the drillfloor, thus requirement for space on same. Also, known bridge rackers will require additional structural arrangement to carry the rackers above the fingerboard. Operations of tripping or addition of stands will include a dangerous human's intervention to physically guide the lower part of the stand of tubulars. Further, an efficient manual backup solution in case such bridge rackers fail requires extra arrangements and specific drillfloor layout. Therefore, there is a need to provide a solution to minimize or eliminate human's intervention in the racking sequence.

SUMMARY

This summary is provided to introduce a selection of concepts that are further described below in the detailed description. This summary is not intended to identify key or essential features of the claimed subject matter, nor is it intended to be used as an aid in determining or limiting the scope of the claimed subject matter as set forth in the claims.

According to some embodiments, a pipe handling system is described that is configured to retrieve and store pipe sections. The system includes: a setback area on a floor being configured to support the weight of a plurality of pipe sections being stored vertically thereon; an upper rack positioned above the setback area including a plurality spaced-apart horizontally oriented upper elongated members configured to accept for storage upper portions of vertical pipe sections in spaces between each pair of upper elongated members; a first gripping device configured to releasably grip a vertical pipe section; and an intermediate rack positioned between the setback area and the upper rack and including a plurality of spaced-apart horizontally oriented intermediate elongated members configured to accept for storage intermediate portions of vertical pipe sections in spaces between each pair of intermediate elongated members, the intermediate rack further comprising a plurality of moveable guides configured to securely translate pipe sections along the spaces between each pair of intermediate elongated members thereby aiding in storing or retrieving of the pipe sections.

According to some embodiments, the moveable guides are configured to move only one selected pipe section along a space between a pair of elongated members at a time while other pipe sections stored between said pair of elongated members remain stationary. The upper elongated members and the intermediate elongated members can be vertically aligned.

According to some embodiments, a second gripping device is positioned below the first gripping device. The first and second gripping devices can be configured to move a pipe section being stored to a location where at least one of the moveable guides can securely contain the pipe section.

According to some embodiments, the pipe handling system forms part of a drilling and tripping system, the floor is drill floor, and the pipe sections are drill string sections. The drilling and tripping system can be configured to drill boreholes used exploration and/or production of hydrocarbons.

According to some embodiments, only half or fewer of the intermediate elongated members includes a moveable guide, and each intermediate elongated member having a moveable guide has a circular cross-section and is configured to rotate about its central longitudinal axis to provide engagement or dis-engagement of the moveable guide with a pipe section.

According to some embodiments, a method is described for vertically handling and storing pipe sections. The method includes: gripping and lifting a first vertical pipe section using a first gripping device; moving the first vertical pipe section towards a vertical pipe storage system; engaging the first vertical pipe section with a first moveable guide on an intermediate elongated member; guiding the first pipe section along a first space between a pair of intermediate elongated members to a predetermined storage location; and lowering and releasing the first pipe section using the first gripping device.

BRIEF DESCRIPTION OF THE DRAWINGS

The subject disclosure is further described in the following detailed description, and the accompanying drawings and schematics of non-limiting embodiments of the subject disclosure. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
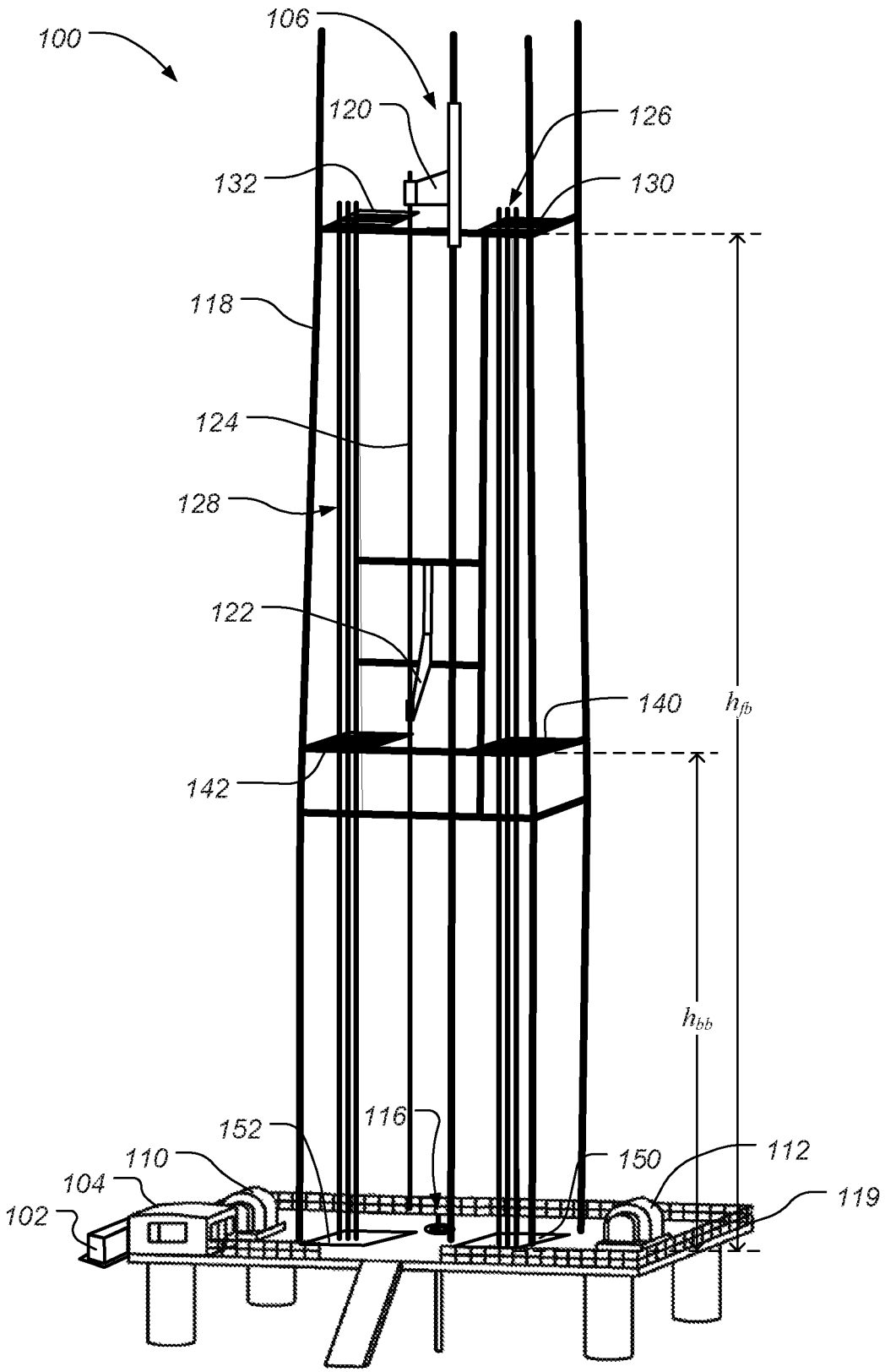
FIG. 1 is a schematic representation of a pipe handling system, according to some embodiments.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The particulars shown herein are for purposes of illustrative discussion of the embodiments of the present disclosure only. In this regard, no attempt is made to show structural details of the present disclosure in more detail than is necessary for the fundamental understanding of the present disclosure, the description taken with the drawings making apparent to those skilled in the art how the several forms of the present disclosure may be embodied in practice. Like reference numerals represent similar or identical parts throughout the several views of the drawings.

FIG. 1 is a schematic representation of a pipe handling system, according to some embodiments. According to some embodiments the pipe handling system 100 is configured for drilling and tripping and includes equipment to drill a subterranean wellbore used for exploration of and/or production of hydrocarbon-bearing fluid from subterranean rock formations. In this case, drilling and tripping system 100 includes a derrick 118, drill floor 119 of the derrick 118 and draw works 110 and 112. Tubular handling equipment is generally shown as 106. Drilling tubulars 126 and 128 (e.g. drill pipe, tubing, and/or casing) are shown racked in fingerboards 130 and 132, respectively. Tubulars 126 and 128 are also shown positioned within bellyboards 140 and 142, respectively, and supported by setbacks 150 and 152, respectively. A bridge racking arm 120 is shown gripping a drilling tubular 124 near its upper end. Tubular 124 is also shown being held or guided by a tubular delivery arm 122. Also shown in FIG. 1 are controls skid 102 to power and functionally control the drilling and pressure control equipment, a pressure control system like a Blowout Preventer (BOP) (not shown) to control pressure of the well and a manifold system to direct and manage fluids to and from mud pumps (not shown). The various equipment and tools of system 100 are monitored and controlled from a DCR 104, located on the rig floor 119. Not shown are other components such as traveling differential roughneck, further draw works, and a top drive. Those skilled in the art will appreciate that the system 100 can be included as part of a drilling rig for onshore or offshore operations, among other things.

The tubular handling equipment 106 is configured to perform vertical pipe handling operations, including racking stands to tubulars, building stands in the mousehole (not shown), picking up singles from the catwalk (not shown), laying out singles to the catwalk, and tripping in and out of the fingerboards 130 and 132. According to some embodiments, the tubular delivery arm assembly 122 is configured to be able to reach a known catwalk machine on drill floor 119 for pick-up of singles of tubulars, build stands in a mousehole position, deliver stands to the bridge racker arm 120 for setback in the fingerboards 130 and 132 as well as reaching the well center 116. According to some embodiments, fingerboard 130, bellyboard 140 and setback 150 are all in vertical alignment. Likewise fingerboard 132, bellyboard 142 and setback 152 are also in vertical alignment. Furthermore the individual fingerboard "fingers" and ellyboards" are aligned such that the spaces between adjacent fingers in the fingerboards and bellyboards are aligned to facilitate storing and retrieving of vertically oriented (or "upright") drilling tubulars. According to some embodiments, fingerboards 130 and/or 132 include a plurality of actuable latches that are configured to secure the top part drilling tubulars positioned therein. Various mechanisms for automatically actuating individual latches on the fingerboards can be provided as is known in the art.

In FIG. 1, $h_{bb}$ denotes the vertical position or height of the bellyboards 140 and 142 above the drill floor 119 (and setbacks 150 and 152), and $h_{fb}$ denotes the vertical position or height of the fingerboards 130 and 132 above the drill floor 119 (and setbacks 150 and 152). According to some embodiments, $h_{bb}$ is in the range of about 25 percent to 75 percent of $h_{fb}$. According to yet some further embodiments, $h_{bb}$ is in the range of about 35 percent to 65 percent of $h_{fb}$. And, according to some embodiments $h_{bb}$ is about 50 percent of $h_{fb}$.

Figure 2:
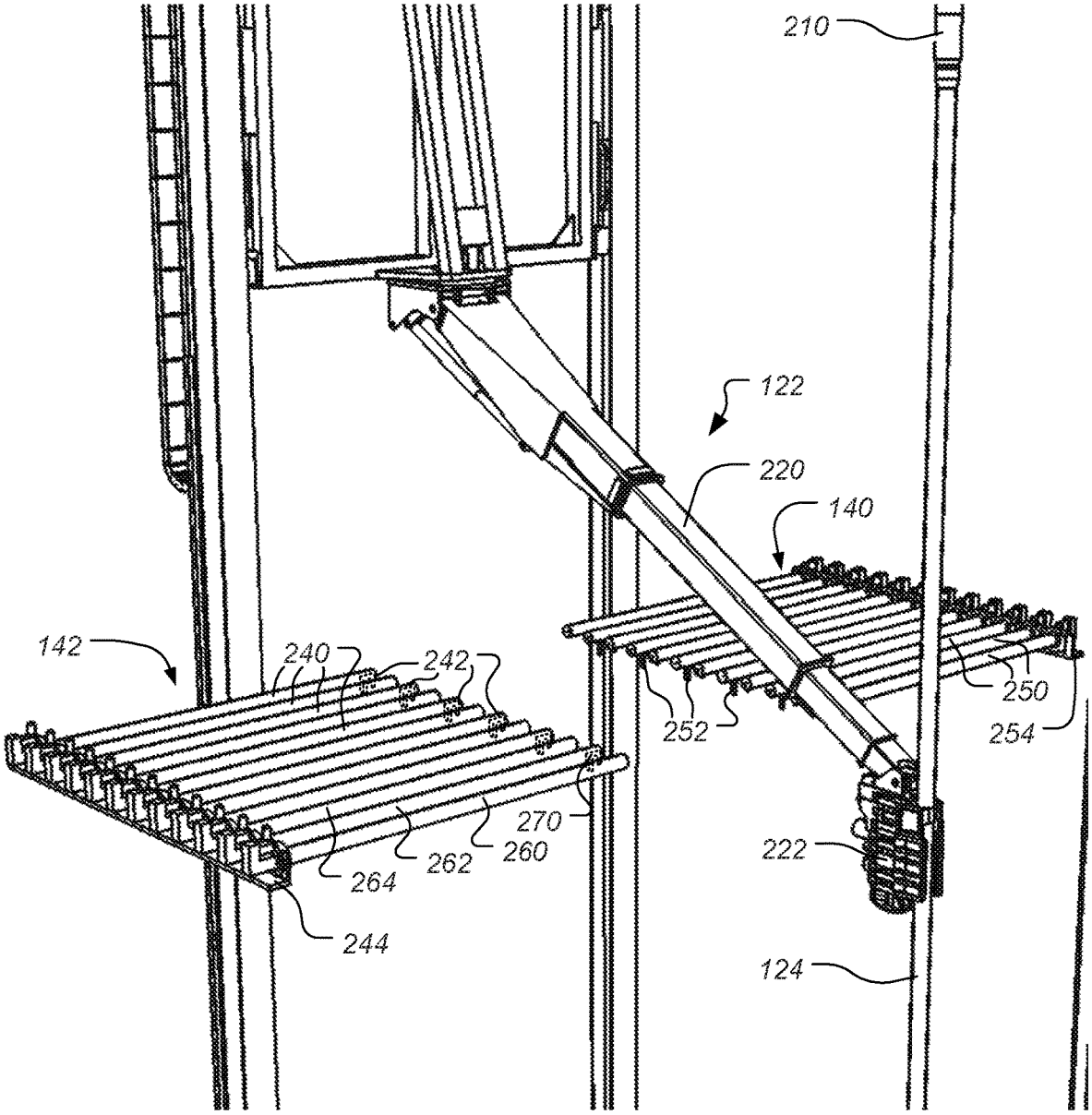
FIGS. 2-5, 6A, 6B, 7A, 7B, 8 and 9 are perspective views illustrating further details of a pipe handling system configured to retrieve and store pipe sections or drilling tubulars, according to some embodiments.

FIGS. 2-5, 6A, 6B, 7A, 7B, 8 and 9 are perspective views illustrating further details of a pipe handling system configured to retrieve and store pipe sections or drilling tubulars, according to some embodiments. FIG. 2 shows bellyboards 140 and 142, as well as tubular delivery arm assembly 122. Bellyboards 140 and 142 include a number of parallel "fingers" 250 and 240, respectively. The fingers 250 and 240 are spaced apart such that the space between each adjacent pair of fingers is able to accommodate the range of expected pipe/tube diameters that will need to be stored and retrieved. The fingers 250 of bellyboard 140 are mounted on a supporting member 254, and fingers 240 of bellyboard 142 are mounted on supporting member 244. According to some embodiments, the bellyboards 140 and 142 are equipped with guides that are adapted to automatically guide a drilling tubular along the length of each inter-finger space or slot. According to some embodiments the guides on the bellyboards 140 and 142 work in concert with bridge racker arm 120 (shown in FIG. 1), which lifts and handles the tubular. In particular, some of the fingers 240 of fingerboard 142 are equipped with moveable guides 242 (shown in dotted outline), and some of the fingers 250 of fingerboard 140 are equipped with moveable guides 252. Shown in fingerboard 142, moveable guide 270 is configured to guide tubulars along the space between fingers 260 and 262, as well as along the space between fingers 262 and 264. According to some embodiments, each of the fingers in bellyboards 140 and 142 have a circular cross-section. The tubular delivery arm assembly 122 is shown to include a telescoping arm 220 and a pipe gripper 222. In FIG. 2, the arm 220 and gripper 222 are shown gripping a drilling tubular 124. Note that according to some embodiments, the tubular 124 would also be gripped by bridge racking arm 120 but this is not visible in FIG. 2.

Figure 3:
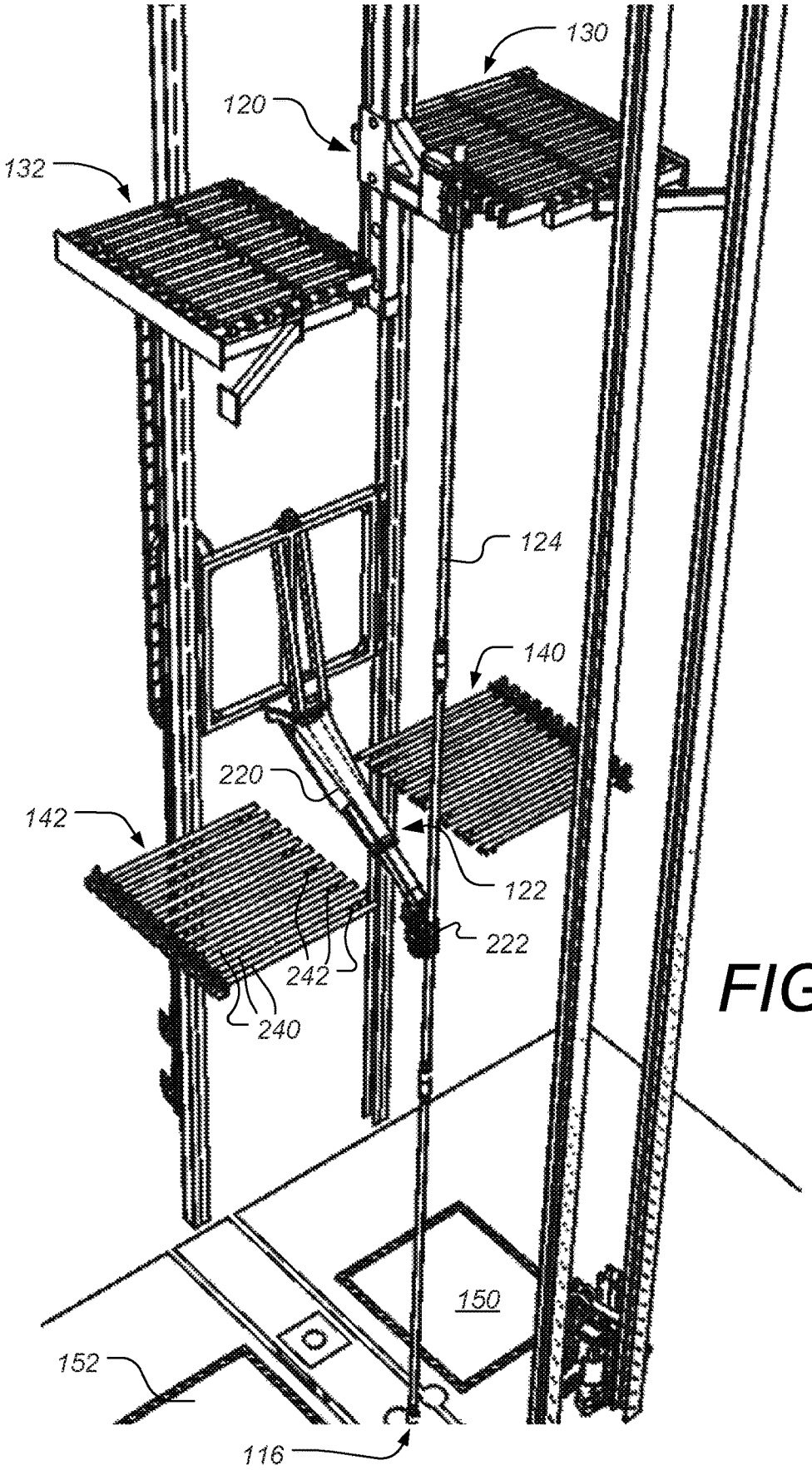

FIG. 3 shows further detail of the tubular 124 being gripped by both bridge racking arm 120 and gripper 222. According to some embodiments, the bridge racking arm 120 is configured to support the entire weight of the drilling tubular, while arm 220 and gripper 222 are configured to guide the tubular to its intended position while not supporting the weight of the tubular. In FIG. 3 the bridge racking arm 120 and tubular delivery arm assembly 122 are shown gripping tubular 124 that is positioned above well center 116, such as would be the case during a tripping operation where tubular 124 is ready to be moved away from the well center 116 and be stored vertically in the fingerboards, bellyboards and setbacks.

Figure 4:
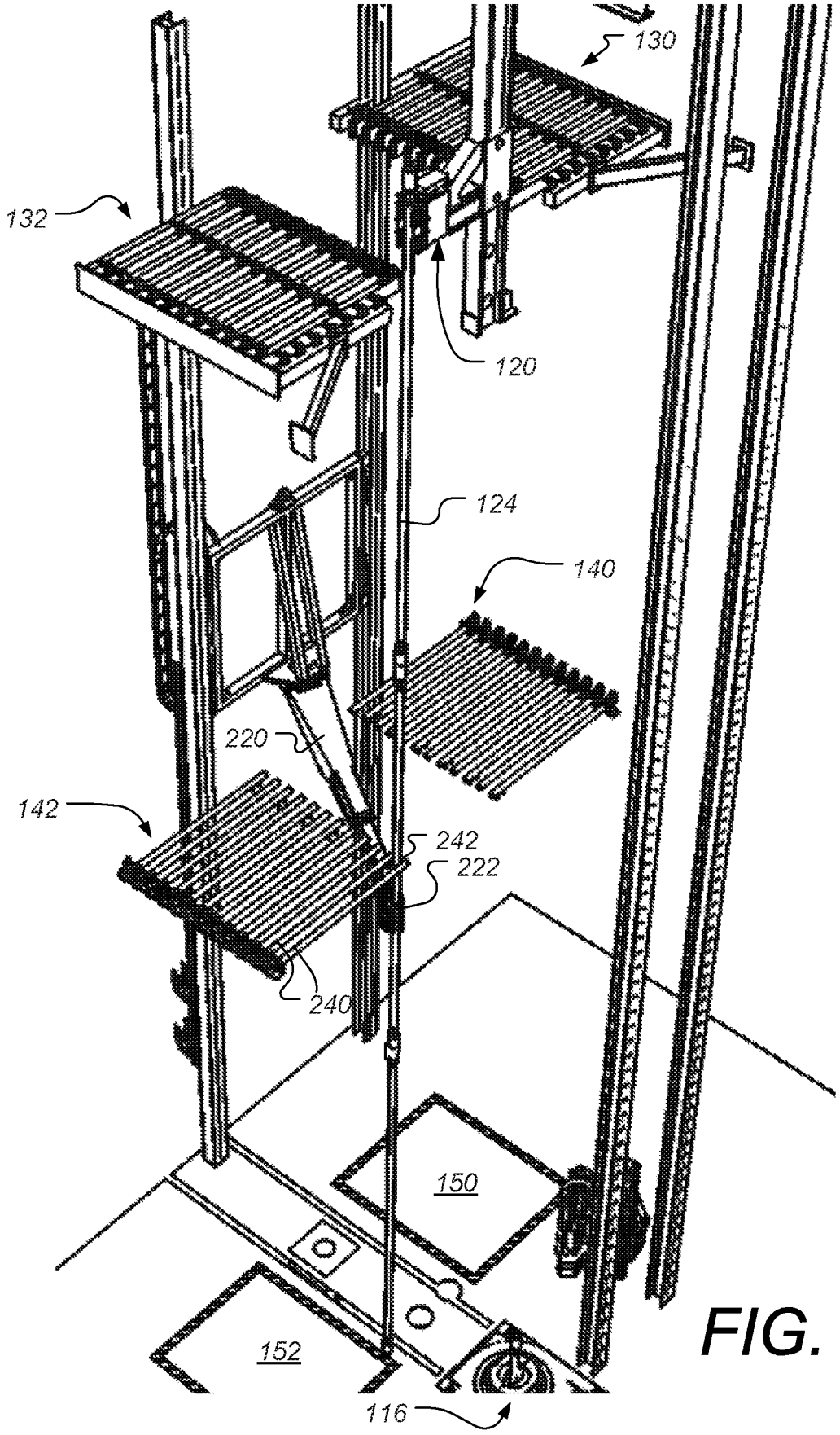

FIG. 4 shows a similar view as FIG. 3, except that tubular 124 has been moved by bridge racking arm 120 and tubular delivery arm assembly 122 to be stored in bellyboard 142, as well as fingerboard 132 and setback 152. According to some embodiments, as can be seen in FIG. 4, the fingers of the bellyboard are slightly longer (or protude slightly further towards well center) than the fingers of the fingerboard. In this case the vertical tubular 124 is shown just passing between the first two fingers 240 of bellyboard 142 while the tubular 124 has not passed between the tips of the fingers of the fingerboard 132.

Figure 5:
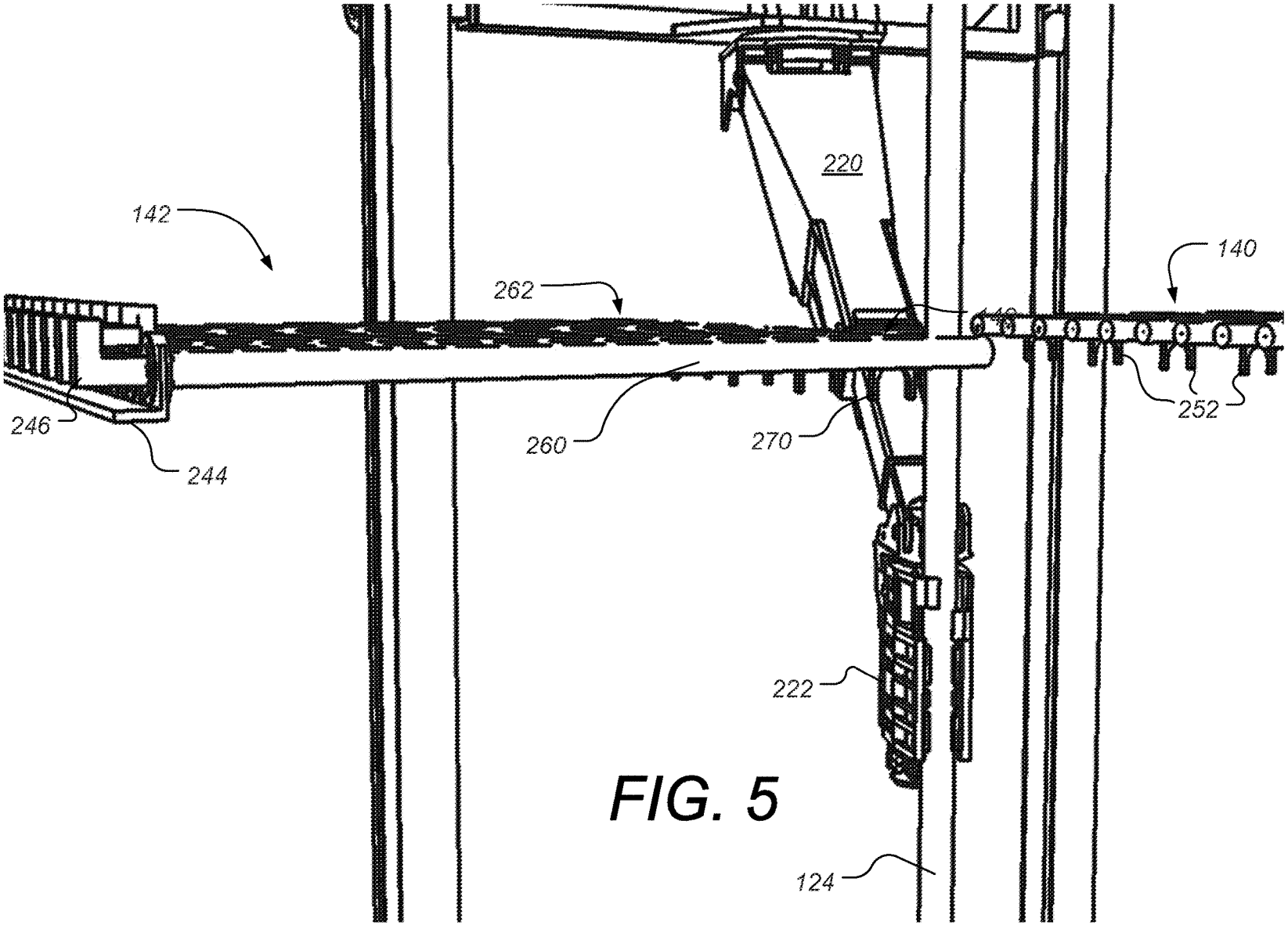

FIG. 5 shows further detail of bellyboard 142 when the tubular 124 is in the position shown in FIG. 4, namely the tubular 124 is just passing the tips of the fingers. The tubular 124 is shown passing between the first two fingers 260 and 262. The moveable guide 270, that is slidably mounted finger 262 is shown not yet engaged with the tubular 124.

Figure 6A:
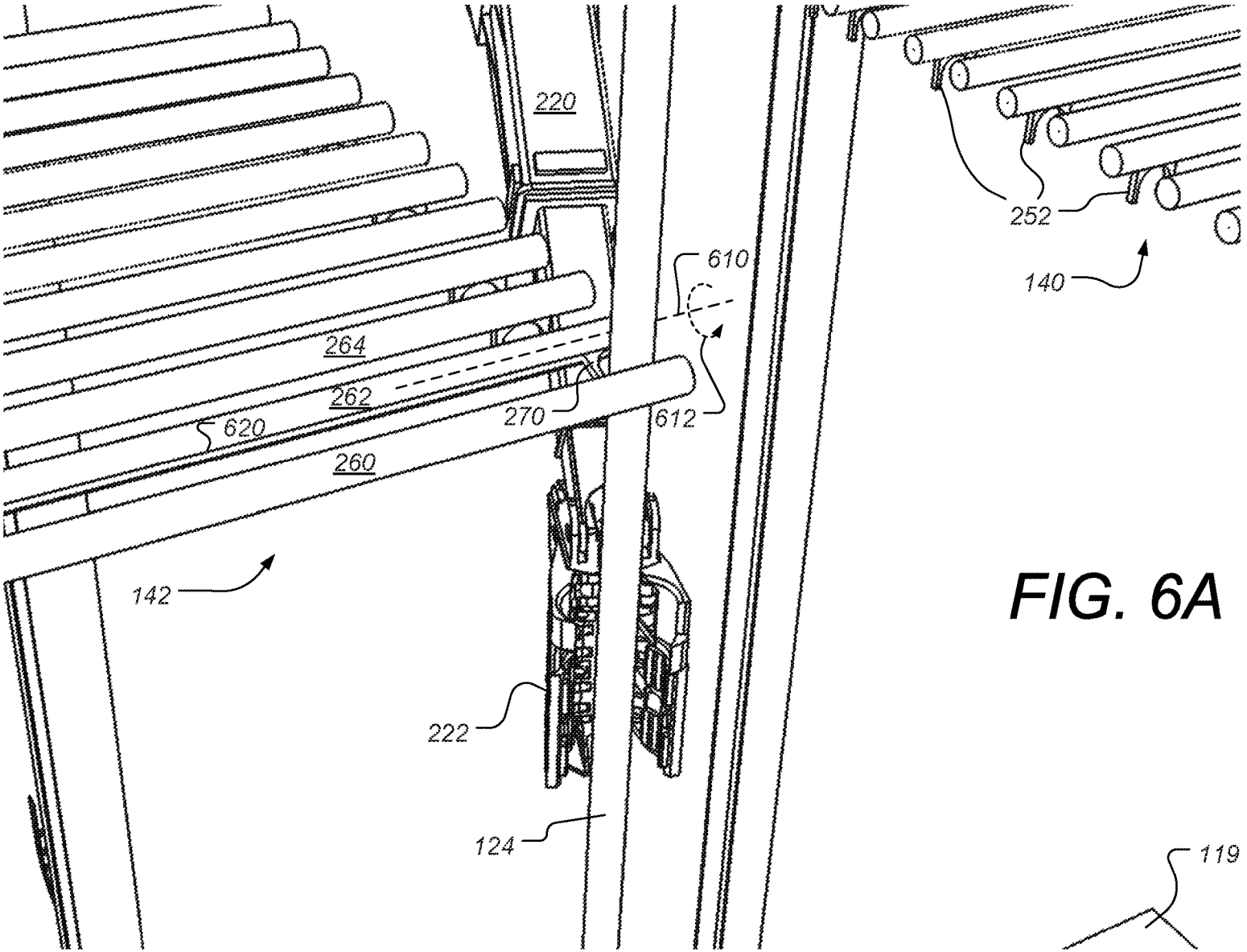
Figure 6B:
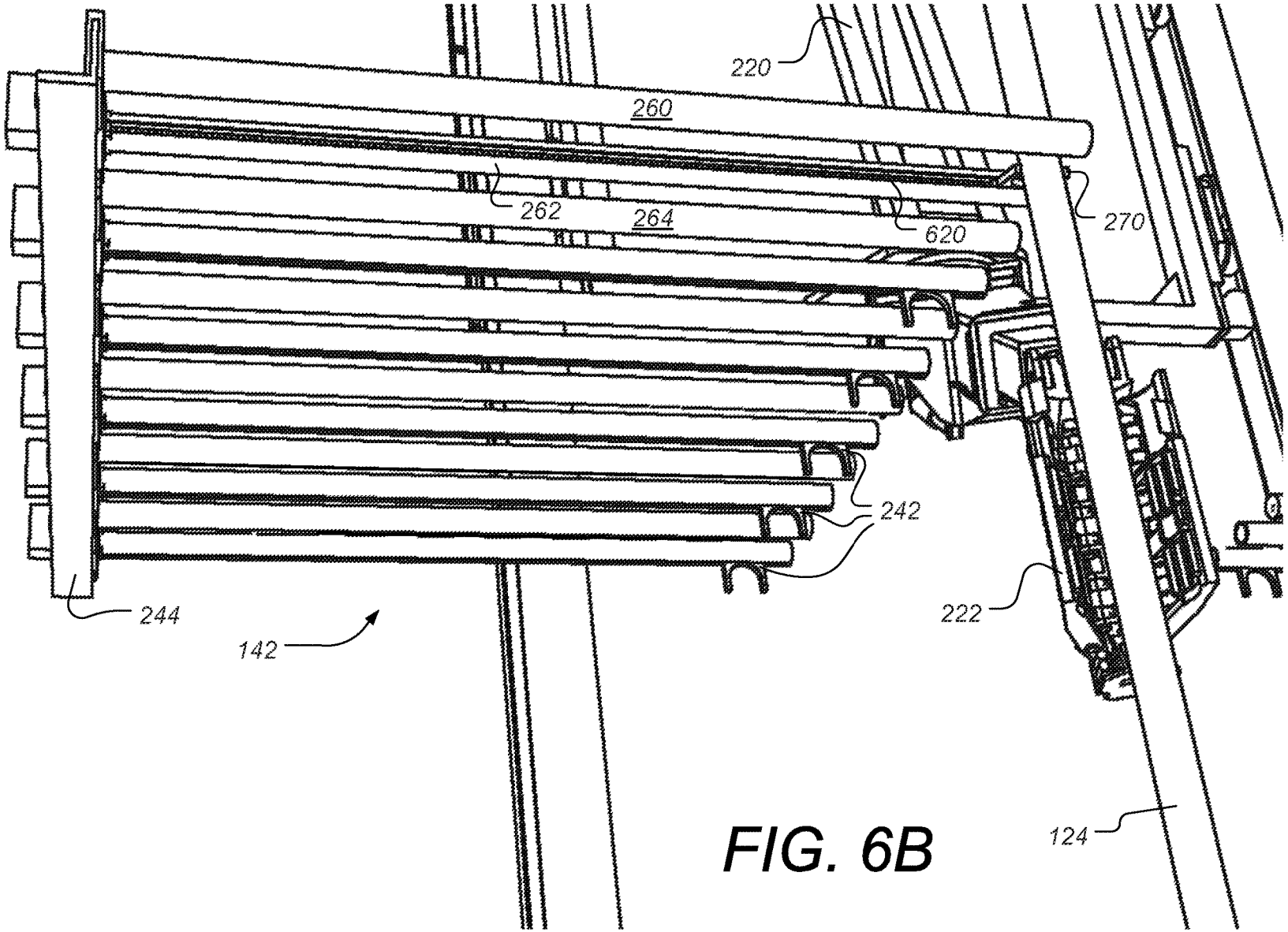

FIG. 6A shows further detail about how the moveable bellyboard guides can engage a tubular being stored (or retrieved), according to some embodiments. In these examples, the guide 270 has a c-shaped opening that is dimensioned to accommodate the expected tube diameter range. The guide 270 is slidably mounted within slot 620 of finger 262 such that it can translate horizontally along the length of slot 620. By rotating the finger 262 about its central longitudinal axis 610 the guide 270 can engage and dis-engage with pipes/tubulars located in the space between fingers 260 and 262, as well as engage and dis-engage with pipes/tubulars located in the space between fingers 262 and 264. In this way, the number of guides and associated actuators and other equipment is simplified since fewer guides are used than the number of slots. According to some other embodiments, each finger can be equipped with its own guide. In the case shown in FIG. 6A, the finger 262 is rotated as shown by dotted arrow 612 such that it engages with tubular 124 positioned between the tips of fingers 260 and 262. Note that once the tubular 124 is engaged by guide 270, the gripper 222 can release the tubular, and the tubular delivery arm assembly is then free to resume other tasks. FIG. 6B shows the system in the same position as shown in FIG. 6A, but from a lower vantage point.

Figure 7A:
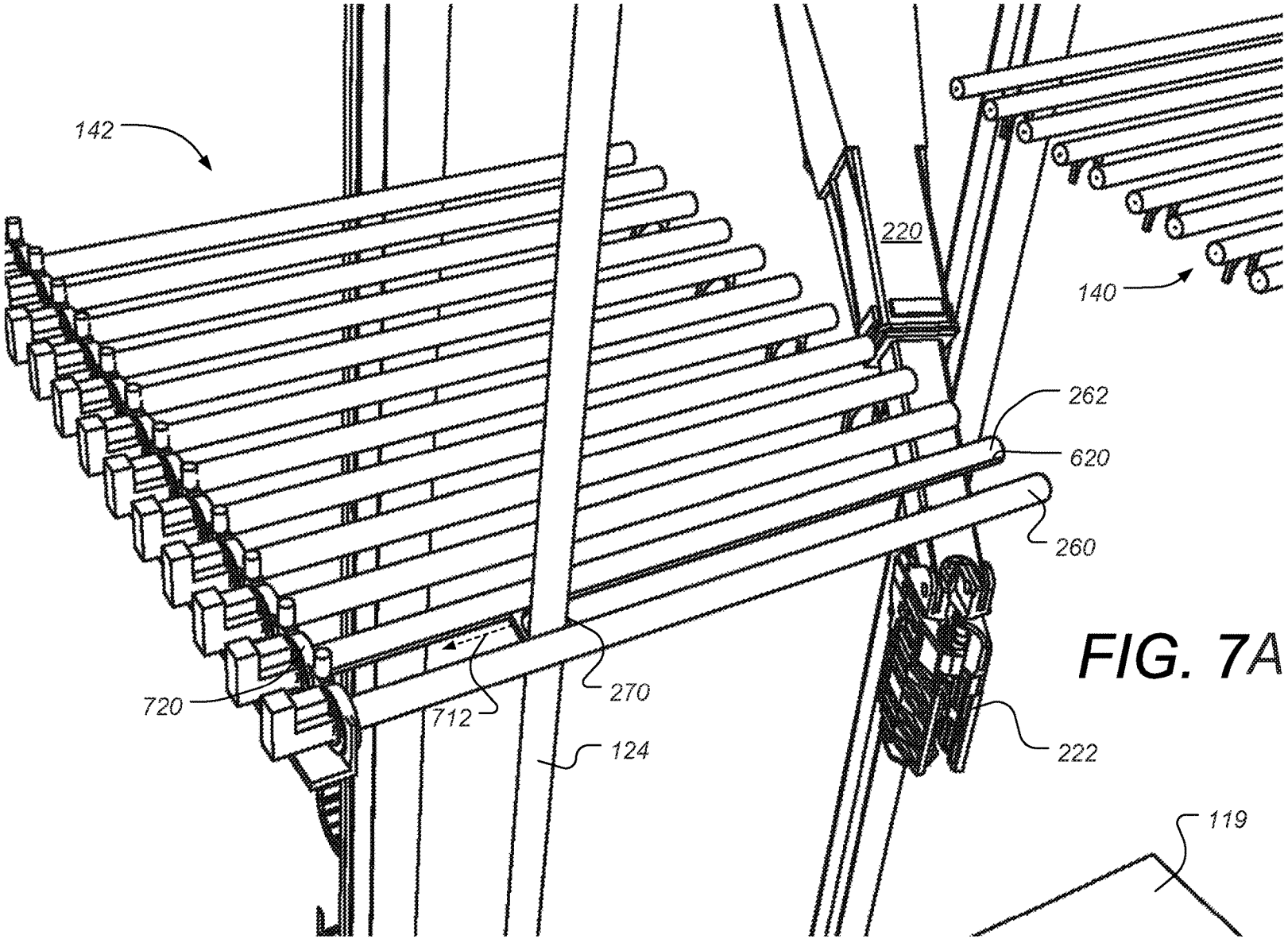
Figure 7B:
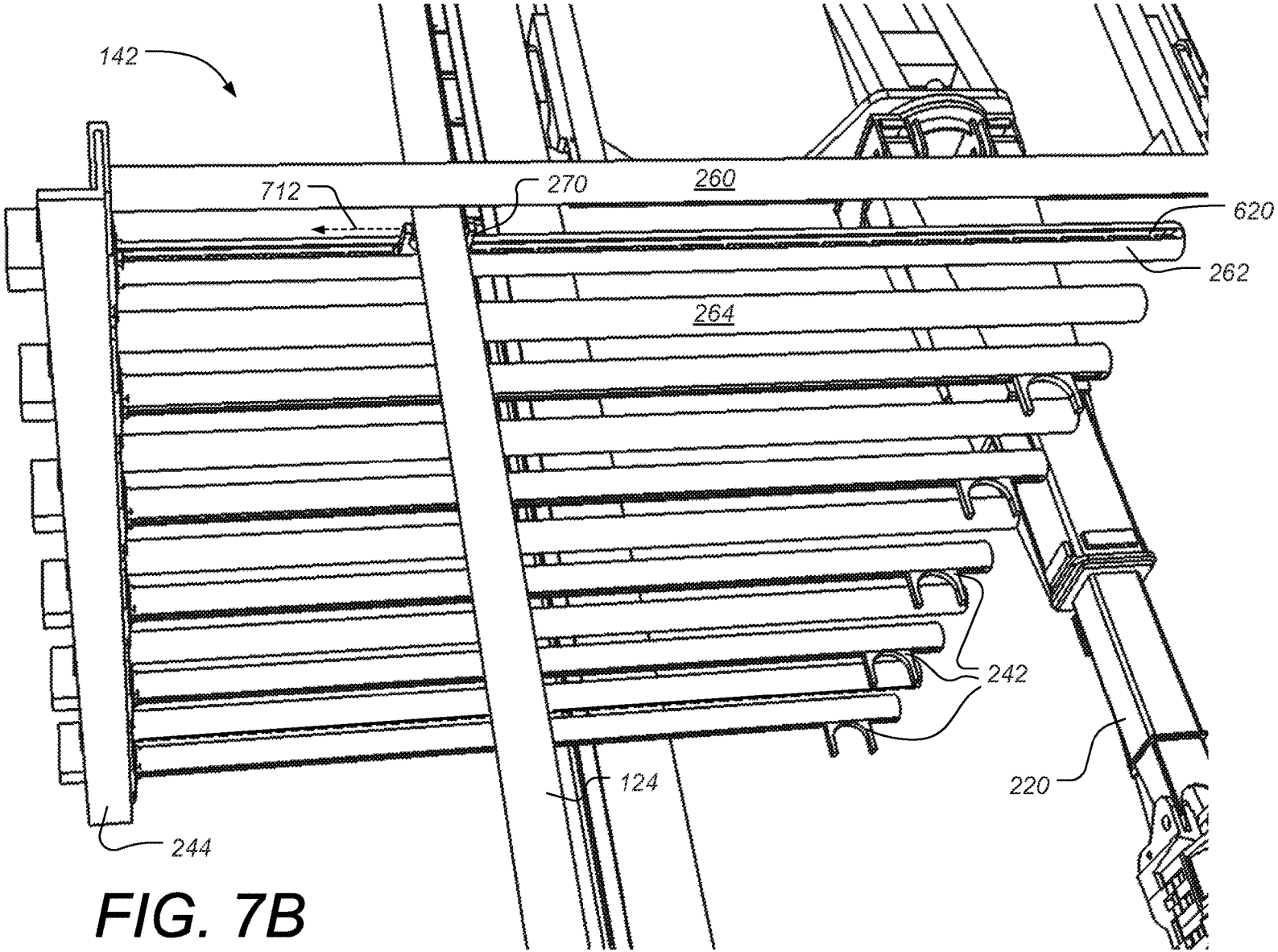

FIG. 7A is a view similar to that of FIG. 6A. In the case of FIG. 7A, the tubular 124 is shown being guided along the inter-finger space by guide 270. The direction of guiding is shown by dotted arrow 712. The tubular 124 is automatically and individually guided towards the innermost space between fingers 260 and 262. According to some embodiments, the tubular is also being guided by bridge racker arm 120 (not shown), which is also bearing the weight of tubular 124. Electric motors 720 are provided at end of each finger having a movable guide. According to some embodiments, two electric motors are provided for each such finger. One motor is used to rotate the entire finger about its central axis (e.g. as shown in arrows 612 and 812 in FIGS. 6A and 8 respectively). A second electric motor is used to drive a lead screw positioned along the length of the finger with the guide mounted to a nut engaged with the lead screw to allow for linear motion of the guide. According to other embodiments, other types of linear actuator arrangements can be used to provide for the linear movement of the guides. FIG. 7B shows the system in the same position as shown in FIG. 7A but from a lower vantage point.

Figure 8:
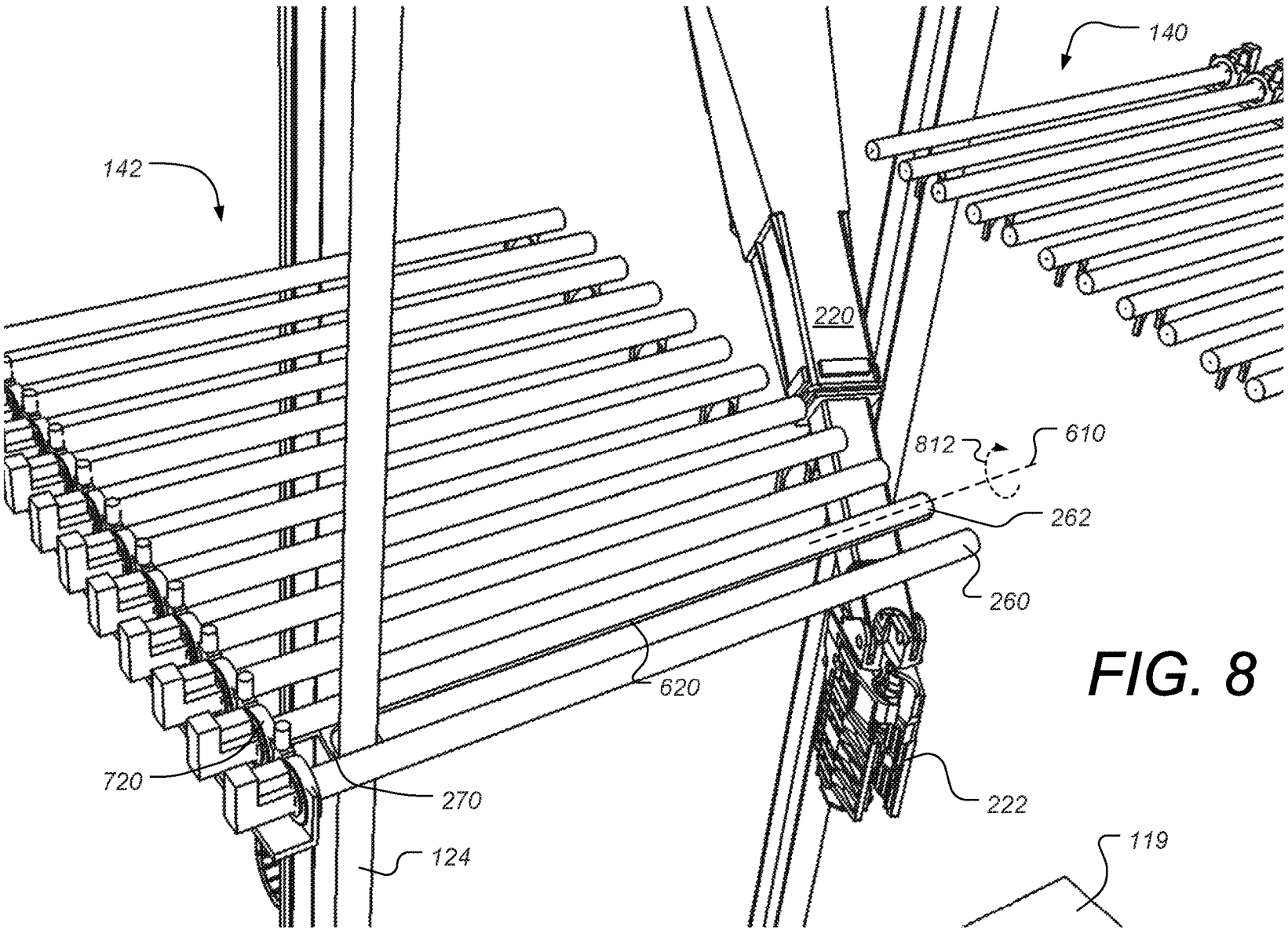
Figure 9:
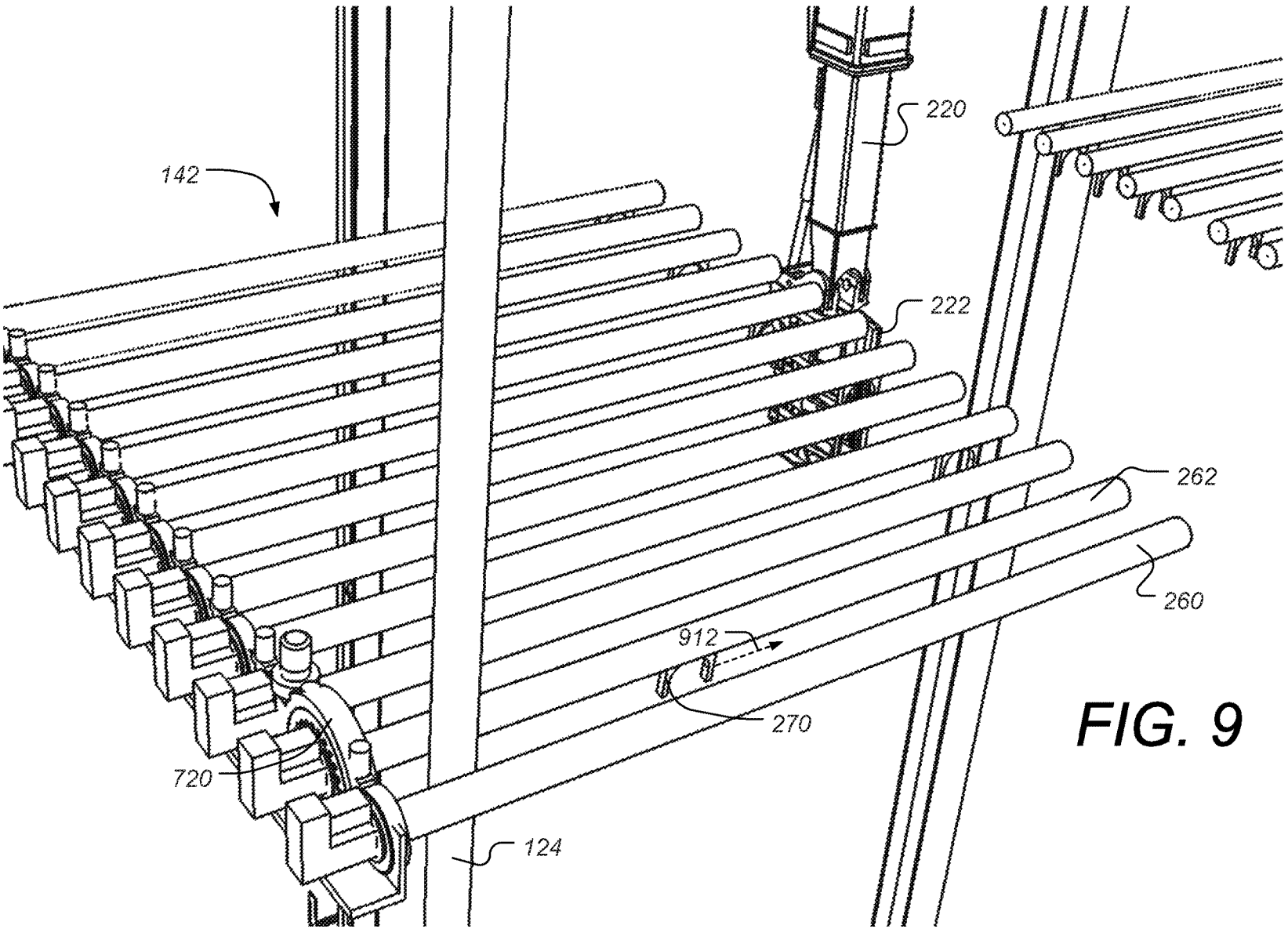

FIG. 8 shows the tubular 124 positioned to the far left side (inner most position) between fingers 260 and 262. In order for guide 270 to release (or dis-engage with) tubular 124, the finger 262 is rotated along its axis 610 in the direction shown by dotted arrow 812. As described supra, one of the motors 720 can be used to rotate finger 262. FIG. 9 shows the guide 270 disengaged with tubular 124 and is returning towards the finger-tip end of the bellyboard as shown by dotted arrow 912 along slot 620 (not shown) of finger 262.

Figure 10:
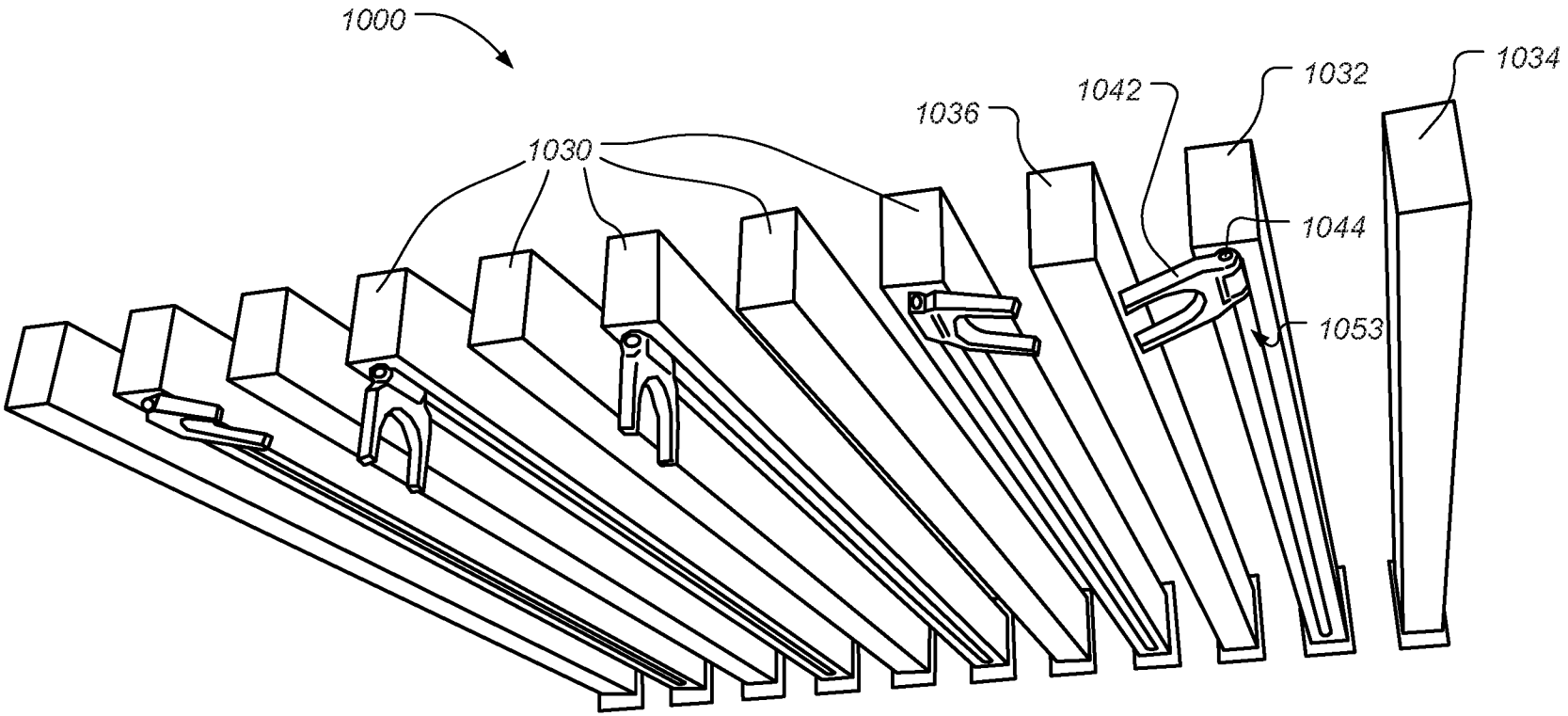
FIG. 10 is a simplified perspective view illustrating a bellyboard having rectangular cross-section fingers, according to some embodiments.

FIG. 10 is a simplified perspective view illustrating a bellyboard having rectangular cross-section fingers, according to some embodiments. In this case shown in FIG. 10, the bellyboard 1000 includes a plurality of fingers 1030. A number of moveable guides are shown protruding below some of the fingers 1030. The guides are mounted to be slide or translate along slots on the undersides of the fingers. For example, guide 1042 is shown mounted in slot 1053 of finger 1032. The guide can actuate left and right using hinge 1044 so that its c-shaped holder can engage a tubular between fingers 1032 and 1036 (as shown in FIG. 10) or between fingers 1032 and 1034, by actuating guide 1042 to the right. The guides 1042 is also configured to slide along slot 1053 on the underside of finger 1032.

Figure 11:
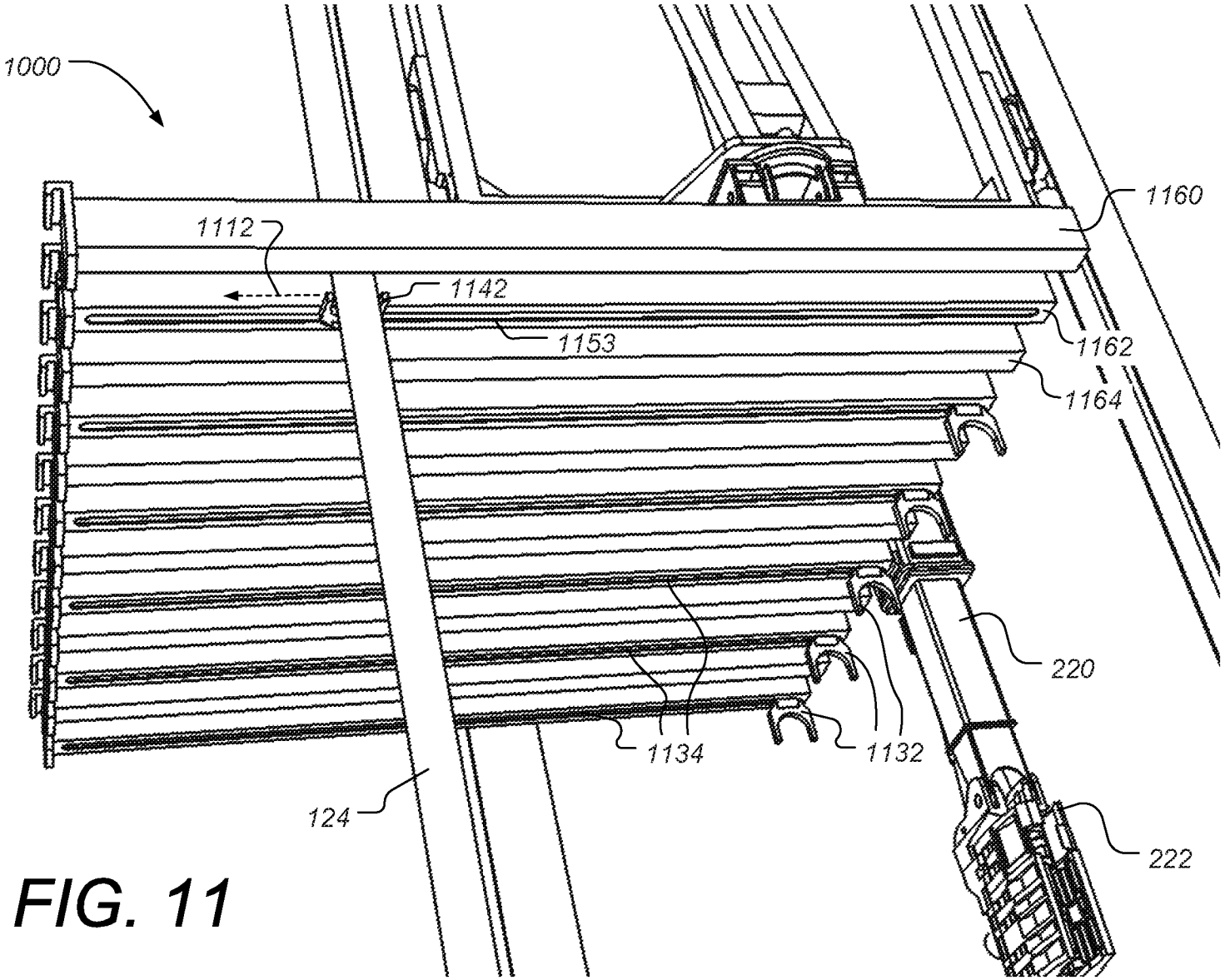
FIG. 11 is a perspective view illustrating further aspects of bellyboard having rectangular cross-section fingers, according to some embodiments.

FIG. 11 is a perspective view illustrating further aspects of a bellyboard having rectangular cross-section fingers, according to some embodiments. FIG. 11 shows bellyboard 1000 incorporated into a pipe handling system such as shown in FIGS. 2-5, 6A, 6B, 7A, 7B, 8 and 9. Tubular 124 is shown being guided along the inter-finger space between rectangular fingers 1160 and 1162 by moveable guide 1142. The direction of movement of guide 1142 and tubular 124 is shown by dotted arrow 1112. The tubular 124 is automatically and individually guided towards the innermost space between fingers 1160 and 1162. According to some embodiments, the tubular is also being guided by bridge racker arm 120 (not shown), which is also bearing the weight of tubular 124. Note that according to some embodiments, each of the guides 1132, including guide 1142 is able to swivel 180 degrees (or nearly 180 degrees) so that each guide can be used to guide tubulars in spaces on either side of the rectangular finger on which the guide is mounted. For example, guide 1142 is able to guide tubulars in the space between fingers 1160 and 1162 (as shown in FIG. 11), as well as guide tubulars in the space between fingers 1162 and 1164. In this way, the number of guides and associated actuators and other equipment is simplified since fewer guides are used than the number of slots. According to some other embodiments, each rectangular finger can be equipped with its own guide. According to some embodiments, a linear actuator such as a lead screw and nut can be used to provide the linear motion to the guides 1132 (including guide 1142) shown in FIG. 11 and guide 1042 shown in FIG. 10. Additionally, according to other embodiments, other designs of finger cross sectional shapes and drive mechanisms can be used. For example, a chain drive and chain pull mechanism could be used to provide the linear motion of the bellyboard guides described herein.

While much of the description supra has been in the context of moving a tubular from the well center and into the fingerboard and bellyboards for storage, such as during a "trip-out" operation, the described components can also be used in reverse to retrieve tubulars stored. For example, during a "trip-in" or a drilling operation, the tubulars stored vertically in the fingerboards, bellyboards and setbacks are individually retrieved with the aid of the moveable bellyboard guides and moved to the well center.

According to some embodiments, the pipe handling system 100 as described herein allow for movement, storage and retrival of the pipes/tubulars without relying on humans to aid in guiding the lower ends of the pipes/tubulars on the drill floor. According to some embodiments, positioning of the bridge racker arm 120, the tubular delivery arm assembly 122 and the bellyboards guides are synchronized using a common drilling control system. The common drilling control system can be located, for example, in DCR 104 and/or control skid 102, both shown in FIG. 1. According to some embodiments, the functions carried out by the pipe handling system 100 may be fully automated with a robotic control system that controls and monitors all operations and reduces risk to the column and the rig due to operator error. According to some embodiments, a control system sends commands and receives feedback from pipe handling system 100 a driller operator might have little or no role at all in the racking sequence.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for" or "step for" performing a function, it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A pipe handling system configured to retrieve and store pipe sections, the pipe handling system comprising:

a setback area on a floor, wherein the setback area is configured to support a weight of a plurality of vertical pipe sections while the plurality of vertical pipe sections are being stored thereon;

an upper rack positioned above the setback area, wherein the upper rack comprises a plurality of spaced-apart horizontally-oriented upper elongated members configured to accept for storage upper portions of the plurality of vertical pipe sections in spaces between each pair of upper elongated members;

a first gripping device configured to releasably grip a first vertical pipe section of the plurality of vertical pipe sections; and an intermediate rack positioned between the setback area and the upper rack, wherein the intermediate rack comprises a plurality of spaced-apart horizontally-oriented intermediate elongated members configured to accept for storage intermediate portions of the plurality of vertical pipe sections in spaces between each pair of intermediate elongated members, wherein the intermediate rack further comprises a plurality of moveable guides, and a first movable guide of the plurality of movable guides is configured to rotate relative to the first vertical pipe section to engage the first vertical pipe section and to translate relative to the intermediate elongated members to translate the first vertical pipe section along a first space of the spaces between a respective pair of intermediate elongated members, thereby aiding in storing or retrieving of the first vertical pipe section.

2. The pipe handling system according to claim 1, wherein the first moveable guide is configured to move only the first vertical pipe section along the first space between the respective pair of intermediate elongated members at a time, while other vertical pipe sections of the plurality of pipe sections stored between the respective pair of intermediate elongated members remain stationary.

3. The pipe handling system according to claim 1, wherein the upper elongated members and the intermediate elongated members are vertically aligned.

4. The pipe handling system according to claim 1, wherein a first vertical distance between the setback area and the intermediate rack is greater than about 25 percent and less than about 75 percent of a second vertical distance between the setback area and the upper rack.

5. The pipe handling system according to claim 4, wherein a first vertical distance between the setback area and the intermediate rack is greater than about 35 percent and less than about 65 percent of a second vertical distance between the setback area and the upper rack.

6. The pipe handling system according claim 1, further comprising a second gripping device positioned below the first gripping device, wherein the first and second gripping devices are configured to move the first vertical pipe section from a first location to a second location that enables the first moveable guide to engage the first vertical pipe section via rotation of the first moveable guide relative to the first vertical pipe section to engage.

7. The pipe handling system according to claim 6, wherein the second gripping device is configured to release the first vertical pipe section after the first vertical pipe section is engaged by the first moveable guide, and the first gripping device is configured to support the first vertical pipe section as the first moveable guide translates relative to the intermediate elongated members to translate the first vertical pipe section.

8. The pipe handling system according to claim 1, wherein the pipe handling system forms part of a drilling and tripping system, the floor is drill floor, and the plurality of vertical pipe sections are drill string sections.

9. The pipe handling system according to claim 8, wherein the drilling and tripping system is configured to drill boreholes used for exploration and/or production of hydrocarbons.

10. The pipe handling system according to claim 1, wherein the plurality of vertical pipe sections range from 30 feet to 200 feet.

11. The pipe handling system according to claim 1, wherein only half or fewer of the intermediate elongated members includes a respective moveable guide of the plurality of movable guides.

12. The pipe handling system according to claim 1, wherein each of the intermediate elongated members is cylindrical with a circular cross section.

13. The pipe handling system according to claim 12, wherein only half or fewer of the intermediate elongated members includes at least one of the plurality of moveable guides, and each intermediate elongated member having at least one of the plurality of moveable guides is configured to rotate about a central longitudinal axis to thereby drive a respective at least one of the plurality of movable guides to rotate to engage or disengage from a respective vertical pipe section of the plurality of vertical pipe sections.

14. A method for vertically handling and storing pipe sections, the method comprising:

gripping and lifting a first vertical pipe section using a first gripping device;

moving the first vertical pipe section towards a vertical pipe storage system, comprising:

a setback area on a floor, wherein the setback area is configured to support a weight of a plurality of vertical pipe sections while the plurality of vertical pipe sections are being stored thereon;

an upper rack positioned above the setback area, wherein the upper rack comprises a plurality spaced-apart horizontally-oriented upper elongated members configured accept for storage upper portions of the plurality of vertical pipe sections in spaces between each pair of upper elongated members; and an intermediate rack positioned between the setback area and the upper rack, wherein the intermediate rack comprises a plurality of spaced-apart horizontally oriented intermediate elongated members configured to accept for storage intermediate portions of the plurality of vertical pipe sections in spaces between each pair of intermediate elongated members, wherein the intermediate rack further comprises a plurality of moveable guides, and a first movable guide of the plurality of movable guides is configured to rotate relative to the first vertical pipe section to engage the first vertical pipe section and to translate relative to the intermediate elongated members to translate the first vertical pipe section along a first space of the spaces between a respective pair of intermediate elongated members, thereby aiding in storing or retrieving of the first vertical pipe section;

engaging the first vertical pipe section with the first moveable guide via rotation of the first movable guide relative to the first vertical pipe section;

guiding the first vertical pipe section along the first space between the respective pair of intermediate elongated members to a storage location via translation of the first movable guide relative to the intermediate elongated members; and lowering and releasing the first vertical pipe section using the first gripping device.

15. The method according claim 14, comprising gripping the first vertical pipe section using a second gripping device of the vertical pipe storage system, and moving the first vertical pipe section from a first location to a second location to enable the first moveable guide to engage the first vertical pipe section via rotation of the first movable guide relative to the first vertical pipe section, wherein the second gripping device is positioned below the first gripping device.

16. The method according claim 15, comprising releasing the first vertical pipe section from the second gripping device after the first vertical pipe section is engaged by the first moveable guide, and thereafter moving the first vertical pipe section to a storage location via translation of the first movable guide relative to the intermediate elongated members as the first gripping device supports the first vertical pipe section.

17. The method of claim 14, comprising:

gripping and lifting a second vertical pipe section using the first gripping device;

moving the second vertical pipe section towards the vertical pipe storage system;

engaging the second vertical pipe section with the first moveable guide via rotation of the first movable guide relative to the second vertical pipe section;

guiding the second vertical pipe section along a second space of the spaces between a respective pair of intermediate elongated members to a respective storage location via translation of the first movable guide relative to the intermediate elongated members; and lowering and releasing the second vertical pipe section using the first gripping device.

18. A pipe handling system configured to store a plurality of pipe sections, the pipe handling system comprising:

a rack comprising a support member that supports a first elongated member, a second elongated member, and a third elongated member, wherein the first elongated member, the second elongated member, and a third elongated member are arranged in a horizontal plane, a first space is defined between the first elongated member and the second elongated member, and a second space is defined between the second elongated member and the third elongated member; and a movable guide slidingly coupled to the second elongated member, wherein the movable guide is configured to rotate relative to the support member and to slide along the second elongated member, thereby enabling the movable guide to engage a first pipe section of the plurality of pipe sections while the first pipe section is positioned within the first space and to guide the first pipe section within the first space during a first time period and to engage a second pipe section of the plurality of pipe sections while the second pipe section is positioned within the second space and to guide the second pipe section within the second space during a second time period.

19. The pipe handling system of claim 18, wherein the second elongated member is configured to rotate relative to the support member to thereby drive the movable guide to rotate relative to the support member.

20. The pipe handling system of claim 19, comprising a first motor configured to drive the second elongated member to rotate relative to the support member and a second motor configured to drive the movable guide to slide along the second elongated member.

* * * * *